US010777146B2

(12) United States Patent
Chou et al.

(10) Patent No.: US 10,777,146 B2
(45) Date of Patent: Sep. 15, 2020

(54) SOURCE DRIVER

(71) Applicant: Novatek Microelectronics Corp., Hsinchu (TW)

(72) Inventors: Chih-Hsien Chou, Hsinchu (TW); Po-Yu Tseng, Taoyuan (TW); Jhih-Siou Cheng, New Taipei (TW); Jin-Yi Lin, Kaohsiung (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/512,414

(22) Filed: Jul. 16, 2019

(65) Prior Publication Data

US 2020/0020283 A1 Jan. 16, 2020

Related U.S. Application Data

(60) Provisional application No. 62/698,302, filed on Jul. 16, 2018.

(51) Int. Cl.
*G09G 3/3291* (2016.01)

(52) U.S. Cl.
CPC ... *G09G 3/3291* (2013.01); *G09G 2310/0291* (2013.01); *G09G 2330/08* (2013.01)

(58) Field of Classification Search
None
See application file for complete search history.

(56) References Cited

U.S. PATENT DOCUMENTS 7,642,846 B2 1/2010 Yan
9,530,356 B2 12/2016 Min et al.
2015/0035813 A1 2/2015 Lei
2015/0091888 A1 4/2015 Min et al.
2015/0379940 A1* 12/2015 Kishi ..... G09G 3/3291 345/690
2016/0314739 A1* 10/2016 Huang ..... G09G 3/3233

FOREIGN PATENT DOCUMENTS

| | | |
|---|---|---|
| CN | 104517566 | 4/2015 |
| EP | 2960894 | 12/2015 |
| TW | 201506873 | 2/2015 |

OTHER PUBLICATIONS

"Office Action of Taiwan Counterpart Application", dated Feb. 24, 2020, p. 1-p. 12.

* cited by examiner

*Primary Examiner* — Aneeta Yodichkas
(74) *Attorney, Agent, or Firm* — JCIPRNET

(57) ABSTRACT

A source driver including a sensing circuit and an operational amplifier is provided. The sensing circuit senses pixel information of an organic light-emitting diode (OLED) pixel circuit. The operational amplifier includes an amplifier circuit and an offset voltage storing and reducing circuit. An input terminal of the amplifier circuit is coupled to the sensing circuit. The amplifier circuit includes a first gain circuit and a second gain circuit. An output terminal of the offset voltage storing and reducing circuit is coupled to a coupling terminal of the first gain circuit. An input terminal of the offset voltage storing and reducing circuit is coupled to an output terminal of the second gain circuit. The offset voltage storing and reducing circuit stores and reduces an offset voltage of the first gain circuit.

20 Claims, 5 Drawing Sheets

SOURCE DRIVER

CROSS-REFERENCE TO RELATED APPLICATION

This application claims the priority benefit of U.S. provisional application Ser. No. 62/698,302, filed on Jul. 16, 2018. The entirety of the above-mentioned patent application is hereby incorporated by reference herein and made a part of this specification.

BACKGROUND

Field of the Invention

The invention relates to a display apparatus and more particularly to a source driver configured to drive an organic light-emitting diode (OLED) display panel.

Description of Related Art

In an organic light-emitting diode (OLED) display device, a thin film transistor (TFT) or an OLED in a pixel circuit decays along with time, and thus, a source driver needs to perform detection and compensation on the pixel circuit. Generally, an operational amplifier in the source driver senses pixel information of an OLED pixel circuit through a sensing line of an OLED display panel, and then, the operational amplifier transmits the pixel information to an analog-to-digital converter (ADC). The ADC converts the pixel information into digital data. This digital data is returned to a system on chip (SoC). The SoC calculates a compensated driving voltage level according to the digital data and returns it to the source driver, thereby achieving the compensation.

In the source driver, the operational amplifier generally has an offset error, and this offset error may affect performance of the overall system. Thus, how to perform offset cancellation on the operational amplifier is one of the technical subjects studied by people in the field.

It should be noted that the contents of the section of "Description of Related Art" is used for facilitating the understanding of the invention. A part of the contents (or all of the contents) disclosed in the section of "Description of Related Art" may not pertain to the conventional technology known to the persons with ordinary skilled in the art. The contents disclosed in the section of "Description of Related Art" do not represent that the contents have been known to the persons with ordinary skilled in the art prior to the filing of this invention application.

SUMMARY

The invention provides a source driver capable of reducing an offset voltage of an amplifier circuit.

According to an embodiment of the invention, a source drive circuit configured to drive an organic light-emitting diode (OLED) display panel is provided. The source driver includes a sensing circuit and an operational amplifier. The sensing circuit is configured to sense pixel information of an OLED pixel circuit through a sensing line of the OLED display panel. The operational amplifier includes an amplifier circuit and an offset voltage storing and reducing circuit. An input terminal of the amplifier circuit is coupled to an output terminal of the sensing circuit. The amplifier circuit includes at least one gain circuit, wherein each of the at least one gain circuit includes a transconductance circuit. An output terminal of the offset voltage storing and reducing circuit is coupled to a coupling terminal of a first gain circuit among the at least one gain circuit of the amplifier circuit. An input terminal of the offset voltage storing and reducing circuit is coupled to an output terminal of a second gain circuit among the at least one gain circuit of the amplifier circuit. The offset voltage storing and reducing circuit is configured to store and reduce an offset voltage of the first gain circuit of the amplifier circuit.

According to an embodiment of the invention, a source drive circuit configured to drive an OLED display panel is provided. The source driver includes a sensing circuit and an operational amplifier. The sensing circuit is configured to sense pixel information of an OLED pixel circuit through a sensing line of the OLED display panel. The operational amplifier includes an amplifier circuit and an offset voltage storing and reducing circuit. An input terminal of the amplifier circuit is coupled to an output terminal of the sensing circuit. The amplifier circuit includes at least one gain circuit, wherein each of the at least one gain circuit includes a transconductance circuit. An output terminal of the offset voltage storing and reducing circuit is coupled to a coupling terminal of a first gain circuit among the at least one gain circuit of the amplifier circuit. An input terminal of the offset voltage storing and reducing circuit is coupled to an output terminal of a second gain circuit among the at least one gain circuit of the amplifier circuit. The offset voltage storing and reducing circuit includes a sampling switch, a sampling capacitor and a transconductance circuit. A first terminal of the sampling switch is coupled to the output terminal of the second gain circuit. The sampling capacitor is coupled to a second terminal of the sampling switch. An input terminal of the transconductance circuit is coupled to the second terminal of the sampling switch. An output terminal of the transconductance circuit of the offset voltage storing and reducing circuit is coupled to the coupling terminal of the first gain circuit of the amplifier circuit.

To sum up, the operational amplifier of the source driver provided by the embodiments of the invention includes the amplifier circuit and the offset voltage storing and reducing circuit. The amplifier circuit includes the at least one gain circuit. The input terminal of the offset voltage storing and reducing circuit is coupled to the output terminal of any one of the at least one gain circuit, so as to store the information about the offset voltage. The output terminal of the offset voltage storing and reducing circuit is coupled to the coupling terminal of the first gain circuit among the at least one gain circuit, so as to reduce the offset voltage of the amplifier circuit.

To make the above features and advantages of the invention more comprehensible, embodiments accompanied with drawings are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
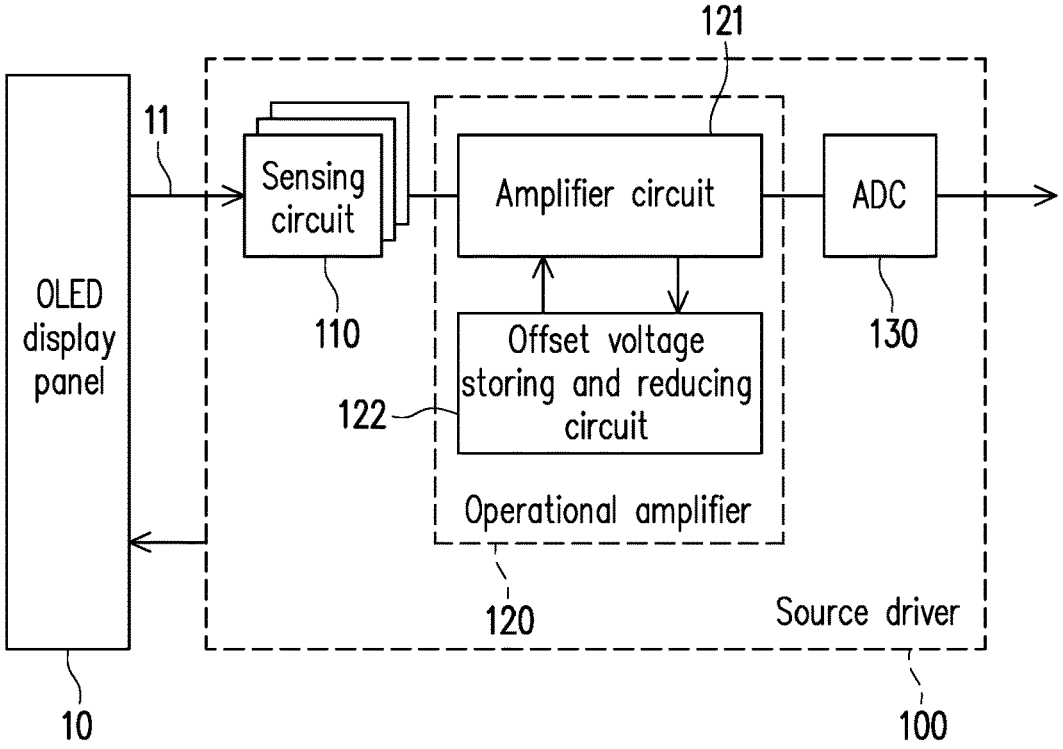
FIG. 1 is a schematic circuit block diagram illustrating a source driver according to an embodiment of the invention.

The term "couple (or connect)" throughout the specification (including the claims) of this application are used broadly and encompass direct and indirect connection or coupling means. For example, if the disclosure describes a first apparatus being coupled (or connected) to a second apparatus, then it should be interpreted that the first apparatus can be directly connected to the second apparatus, or the first apparatus can be indirectly connected to the second apparatus through other devices or by a certain coupling means. In addition, terms such as "first" and "second" mentioned throughout the specification (including the claims) of this application are only for naming the names of the elements or distinguishing different embodiments or scopes and are not intended to limit the upper limit or the lower limit of the number of the elements not intended to limit sequences of the elements. Moreover, elements/components/steps with same reference numerals represent same or similar parts in the drawings and embodiments. Elements/components/notations with the same reference numerals in different embodiments may be referenced to the related description.

FIG. 1 is a schematic circuit block diagram illustrating a source driver 100 according to an embodiment of the invention. The source driver 100 may drive an organic light emitting diode (OLED) display panel 10. The details related to the source driver 100 driving the OLED display panel 10 are not limited in the present embodiment. Based on a design requirement, for example, the source driver 100 may be disposed with a conventional source driving circuit or other drive circuits, so as to drive a plurality of source lines (data lines) of the OLED display panel 10.

In the embodiment illustrated in FIG. 1, the source driver 100 includes a sensing circuit 110, an operational amplifier 120 and an analog-to-digital converter (ADC) 130. The sensing circuit 110 can also be implemented (or referred to) as a sample and hold circuit. The sensing circuit 110 may sense pixel information of an OLED pixel circuit (not shown) in the OLED display panel 10 through a sensing line 11 of the OLED display panel 10. The implementation details of the OLED pixel circuit are not limited in the present embodiment. Based on a design requirement, for example, the OLED pixel circuit may be a conventional pixel circuit or other pixel circuits.

The operational amplifier 120 is coupled to the sensing circuit 110 to receive the pixel information. Namely, the sensing circuit 120 may sense the pixel information of the OLED pixel circuit (not shown) through the sensing line 11 of the OLED display panel 10, and then, the operational amplifier 120 may transmit the pixel information to the ADC 130. The ADC 130 may convert the pixel information into digital data. The digital data may be processed (for example, by a timing control circuit) to obtain a compensated driving voltage level according to the digital data and be returned to the source driver 100, thereby achieving the compensation.

In the embodiment illustrated in FIG. 1, the operational amplifier 120 includes an amplifier circuit 121 and an offset voltage storing and reducing circuit 122. An input terminal of the amplifier circuit 121 is coupled to an output terminal of the sensing circuit 110 to receive the pixel information. The amplifier circuit 121 includes at least one gain circuit, wherein each of the at least one gain circuit includes a transconductance circuit.

For example, the amplifier circuit 121 includes a plurality of gain circuits comprising a first gain circuit and a second gain circuit connected in series. The first gain circuit may be served as an input stage of the amplifier circuit 121. In some embodiments, the second gain circuit may be served as an intermediate stage following the input stage of the amplifier circuit 121 and the intermediate stage may be followed by another output stage of the amplifier circuit 121. In some other embodiments, the second gain circuit may be served as an output stage another at least one intermediate stage following the input stage of the amplifier circuit 121. Moreover, in some embodiments, the first gain circuit and the second gain circuit may be collectively served as an input stage of the amplifier circuit 121.

An output terminal of the offset voltage storing and reducing circuit 122 is coupled to a coupling terminal of the first gain circuit of the amplifier circuit 121. An input terminal of the offset voltage storing and reducing circuit 122 is coupled to an output terminal of the second gain circuit of the amplifier circuit 121. The offset voltage storing and reducing circuit 122 may be configured to store and reduce an offset voltage of the first gain circuit of the amplifier circuit 121.

For example, in a reset phase, the offset voltage storing and reducing circuit 122 may store a first voltage received from the output terminal of the second gain circuit of the amplifier circuit 121, wherein the first voltage carries information about the offset voltage of the first gain circuit of the amplifier circuit 121. In an amplification phase, the offset voltage storing and reducing circuit 122 may output a second voltage to the coupling terminal of the first gain circuit of the amplifier circuit 121, wherein the second voltage carries information for reducing the offset voltage of the first gain circuit of the amplifier circuit 121.

Figure 2:
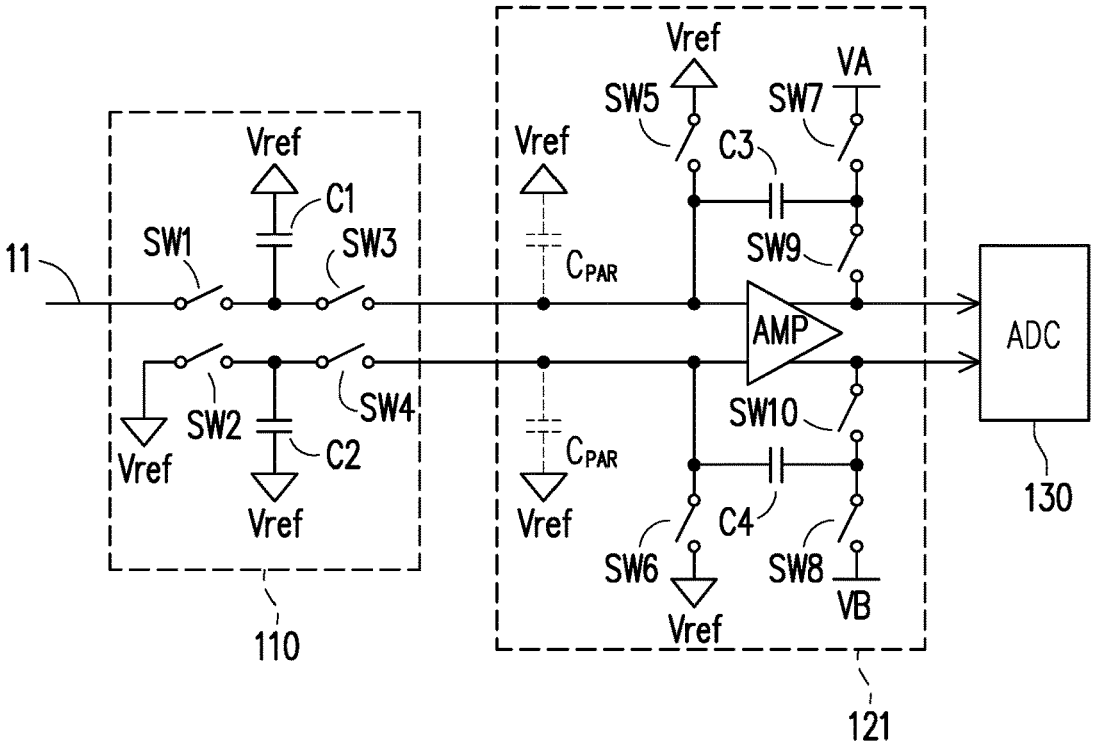
FIG. 2 is a schematic circuit block diagram illustrating the sensing circuit and the amplifier circuit depicted in FIG. 1 according to an embodiment of the invention.

FIG. 2 is a schematic circuit block diagram illustrating the sensing circuit 110 and the amplifier circuit 121 depicted in FIG. 1 according to an embodiment of the invention. In the embodiment illustrated in FIG. 2, the sensing circuit 110 includes a sampling switch SW1, a sampling switch SW2, a sampling capacitor C1, a sampling capacitor C2, a switching circuit SW3 and a switching circuit SW4. A first terminal of the sampling switch SW1 is coupled to the sensing line 11 of the OLED display panel 10, and a first terminal of the sampling switch SW2 is coupled to a reference voltage Vref. A level of the reference voltage Vref may be determined based on a design requirement. For example, the reference voltage Vref may be a common mode voltage, a ground voltage or any other reference voltage. In a sampling period (sensing period), the sampling switch SW1 and the sampling switch SW2 are turned on. In a non-sampling period, the sampling switch SW1 and the sampling switch SW2 are turned off.

A first terminal of the sampling capacitor C1 is coupled to a second terminal of the sampling switch SW1. A second terminal of the sampling capacitor C1 is coupled to the reference voltage Vref. A first terminal of the sampling capacitor C2 is coupled to a second terminal of the sampling switch SW2. A second terminal of the sampling capacitor C2 is coupled to the reference voltage Vref. A first terminal of the switching circuit SW3 is coupled to the first terminal of the sampling capacitor C1. A first terminal of the switching circuit SW4 is coupled to the first terminal of the sampling capacitor C2. Second terminals of the switching circuit SW3 and the switching circuit SW4 serve as output terminals of the sensing circuit 110. When the sensing line 11 is selected as the current sensing line, in the reset phase, the switching circuit SW3 and the switching circuit SW4 are turned off. When the sensing line 11 is selected as the current sensing line, in the amplification phase, the switching circuit SW3 and the switching circuit SW4 are turned on. When the sensing line 11 is not the current sensing line, the switching circuit SW3 and the switching circuit SW4 are turned off.

In the embodiment illustrated in FIG. 2, the amplifier circuit 121 includes a switch SW5, a switch SW6, a switch SW7, a switch SW8, a switch SW9, a switch SW10, a capacitor C3, a capacitor C4 and an amplifier AMP. A capacitance $C_{PAR}$ illustrated in FIG. 2 represents to a parasitic capacitance.

A first terminal of the capacitor C3 is coupled to a first input terminal of the amplifier AMP of the operational amplifier 120. A first terminal of the capacitor C4 is coupled to a second input terminal of the amplifier AMP of the operational amplifier 120. A first terminal of the switch SW5 is coupled to the first terminal of the capacitor C3. A first terminal of the switch SW6 is coupled to the first terminal of the capacitor C4. Second terminals of the sampling switch SW5 and the sampling switch SW6 are coupled to the reference voltage Vref. The level of the reference voltage Vref may be determined based on a design requirement. For example, the reference voltage Vref may be a common mode voltage, a ground voltage or any other reference voltage.

A first terminal of the switch SW9 is coupled to a second terminal of the capacitor C3. A first terminal of the switch SW10 is coupled to a second terminal of the capacitor C4. Second terminals of the sampling switch SW9 and the sampling switch SW10 are respectively coupled to a first output terminal and a second output terminal of the amplifier AMP of the operational amplifier 120. The first output terminal and the second output terminal of the amplifier AMP are coupled to the ADC 130. A first terminal of the switch SW7 is coupled to the second terminal of the capacitor C3. A second terminal of the switch SW7 is coupled to a reference voltage VA. A first terminal of the switch SW8 is coupled to the second terminal of the capacitor C4. A second terminal of the switch SW8 is coupled to a reference voltage VB.

Levels of the reference voltage VA and the reference voltage VB may be determined based on a design requirement. For example, the reference voltages VA and VB may have the same voltage level. Alternatively, the amplifier circuit 121 may use different reference voltages VA and VB, so as to generate an offset voltage level from the output terminals of the amplifier AMP.

In the sampling period (sensing period), the pixel information of the sensing line 11 and the reference voltage Vref are respectively stored in the sampling capacitors C1 and C2. In the reset phase, the switch SW9 and the switch SW10 are turned off, and the switch SW5, the switch SW6, the switch SW7 and the switch SW8 are turned on, such that the capacitor C3 and the capacitor C4 respectively store the reference voltage VA and the reference voltage VB.

In the amplification phase, the switch SW9 and the switch SW10 are turned on, and the switch SW5, the switch SW6, the switch SW7 and the switch SW8 are turned off. When the sensing line 11 is selected as the current sensing line, in the amplification phase, the pixel information stored in the sampling capacitors C1 and C2 are transmitted to the input terminals of the amplifier AMP. In an ideal situation (i.e., there is neither any parasitic capacitance nor any offset voltage), the amplifier AMP amplifies the pixel information by a parameter of C3/C1 (or C4/C2) to generate an output signal to the ADC 130.

In an actual situation, the amplifier circuit 121 may have a parasitic capacitance and an offset voltage, which may cause an offset error. In order to reduce the offset error, the offset voltage storing and reducing circuit 122 may reduce the offset voltage of the amplifier AMP. Alternatively, the offset error may be reduced by increasing capacitance values of the sampling capacitors C1 and C2. Since the ratio of C3/C1 (or C4/C2) is fixed (in order to satisfy a required gain), capacitance values of the capacitors C3 and C4 also have to be proportionally increased in a condition that the capacitance values of the sampling capacitors C1 and C2 are increased.

Figure 3:
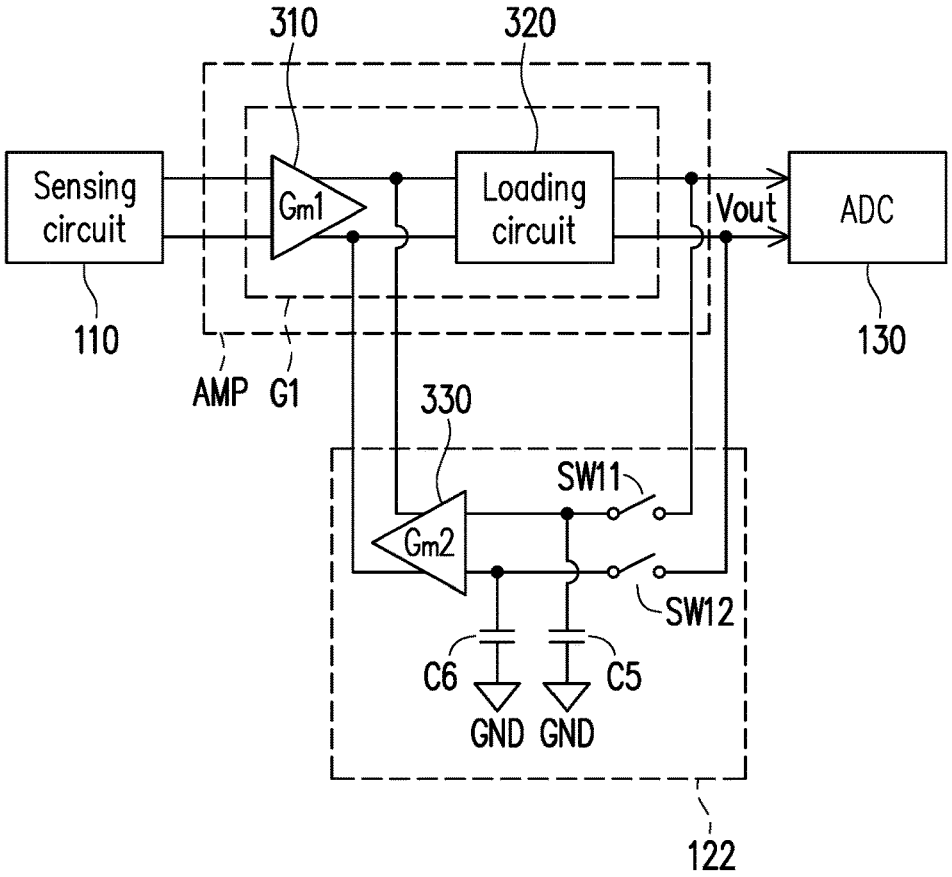
FIG. 3 is a schematic circuit block diagram illustrating the offset voltage storing and reducing circuit depicted in FIG. 1 and the amplifier depicted in FIG. 2 according to an embodiment of the invention.

FIG. 3 is a schematic circuit block diagram illustrating the offset voltage storing and reducing circuit 122 depicted in FIG. 1 and the amplifier AMP depicted in FIG. 2 according to an embodiment of the invention. In the embodiment illustrated in FIG. 3, the amplifier AMP includes a gain circuit G1. An input terminal of the gain circuit G1 serves as an input terminal of the amplifier AMP, which is coupled to the sensing circuit 110. An output terminal of the gain circuit G1 serves as an output terminal of the amplifier AMP, which is coupled to the ADC 130. The implementation manner of the gain circuit G1 is not limited in the invention. For example, based on a design requirement, the gain circuit G1 may be a conventional gain circuit of a conventional operational amplifier, or alternatively, the gain circuit G1 may be other gain circuits.

In the embodiment illustrated in FIG. 3, the gain circuit G1 includes a transconductance circuit 310 and a loading circuit 320. An input terminal of the transconductance circuit 310 is coupled to the sensing circuit 110. The loading circuit 320 is coupled to an output terminal of the transconductance circuit 310 in the gain circuit G1. The output terminal of the transconductance circuit 310 may serve as a coupling terminal of the gain circuit G1. An output terminal of the loading circuit 320 is coupled to the ADC 130. The implementation manners of the transconductance circuit 310 and the loading circuit 320 are not limited in the present embodiment. Based on a design requirement, the transconductance circuit 310 may be a conventional transconductance circuit or other transconductance circuits. Based on a design requirement, the loading circuit 320 may be a conventional loading circuit in a conventional gain circuit, or alternatively, the loading circuit 320 may be other loading circuits. For example, an input pair may serve as the transconductance circuit 310 of the gain circuit G1 of the amplifier circuit 121, and a gain stage may serve as the loading circuit 320 of the gain circuit G1 of the amplifier circuit 121.

The output terminal of the offset voltage storing and reducing circuit 122 is coupled to the output terminal (i.e., the coupling terminal of the gain circuit G1) of the transconductance circuit 310. The input terminal of the offset voltage storing and reducing circuit 122 is coupled to the output terminal of the gain circuit G1. The offset voltage storing and reducing circuit 122 may store and reduce an offset voltage of the gain circuit G1.

In the embodiment illustrated in FIG. 3, the offset voltage storing and reducing circuit 122 includes a sampling switch SW11, a sampling switch SW12, a sampling capacitor C5, a sampling capacitor C6 and a transconductance circuit 330. First terminals of the sampling switch SW11 and the sampling switch SW12 (i.e., the input terminal of the offset voltage storing and reducing circuit 122) are coupled to the output terminals of the gain circuit G1, respectively. A first terminal of the sampling capacitor C5 is directly coupled to a second terminal of the sampling switch SW11. A first terminal of the sampling capacitor C6 is directly coupled to a second terminal of the sampling switch SW12. Second terminals of the sampling capacitor C5 and the sampling capacitor C6 are coupled to reference voltages (e.g. ground voltage GND, system power voltage or any other reference voltage). An input terminal of the transconductance circuit 330 is coupled to the second terminals of the sampling switch SW11 and the sampling switch SW12. The output terminal of the transconductance circuit 330 (i.e., the output terminal of the offset voltage storing and reducing circuit 122) is coupled to the output terminal (i.e., the coupling terminal of the gain circuit G1) of the transconductance circuit 310. The implementation manner of the transconductance circuit 330 is not limited in the invention. For example, based on a design requirement, the transconductance circuit 330 may be a conventional transconductance circuit or other transconductance circuits.

It is assumed that an offset voltage of the transconductance circuit 310 (i.e., the offset voltage of the gain circuit G1) is Vos1, and an offset voltage of the transconductance circuit 330 is Vos2. Referring to FIG. 2 and FIG. 3, in the reset phase, the switch SW5, the switch SW6, the sampling switch SW11 and the sampling switch SW12 are turned on, and the switching circuit SW3 and the switching circuit SW4 are turned off. In this circumstance, an output Vout of the amplifier AMP is −Vos1*Gm1/Gm2-Vos2, wherein Gm1 represents a transconductance value of the transconductance circuit 310, and Gm1 represents a transconductance value of the transconductance circuit 330. The output Vout is stored in the sampling capacitor C5 and the sampling capacitor C6 in the reset phase.

In the amplification phase, the switch SW5, the switch SW6, the sampling switch SW11 and the sampling switch SW12 are turned off, and the switching circuit SW3 and the switching circuit SW4 are turned on. In this circumstance, the offset voltage is Vos'=Vos1/(Gm2*R)+Vos2/(Gm1*R), wherein R represents a resistance value of the loading circuit 320. The input offset voltage Vos1 of the transconductance circuit 310 is divided by an open-loop gain which is Gm2*R, the input offset voltage Vos2 of the transconductance circuit 330 is divided by an open-loop gain which is Gm1*R, and thus, the offset voltage of the amplifier circuit 121 may be effectively reduced. In an actual design, the open-loop gains are usually large enough, and thus, the offset voltages Vos1 and Vos2 may be omitted, such that an input referred offset may be eliminated.

It should be noted that because the sampling switch SW11 and the sampling switch SW12 are turned off in the amplification phase, the offset voltage storing and reducing circuit 122 does not cause any loading effect to the amplifier circuit 121. Furthermore, because the sampling capacitor C5 and the sampling capacitor C6 are not in a signal path, the sampling capacitor C5 and the sampling capacitor C6 do not influence a capacitor design of the amplifier circuit 121, that is, capacitance values (areas) of the sampling capacitor C5 and the sampling capacitor C56 may be reduced as much as possible.

Figure 4:
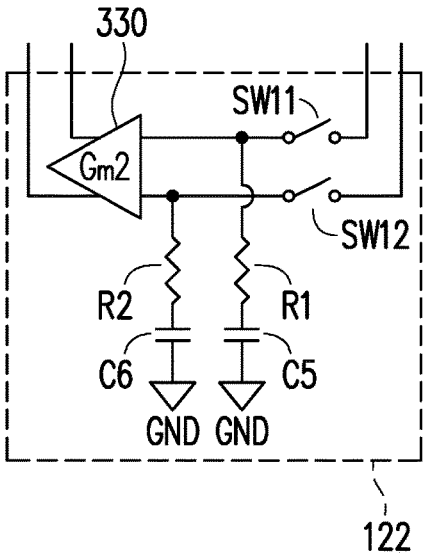
FIG. 4 is a schematic circuit block diagram illustrating the offset voltage storing and reducing circuit depicted in FIG. 1 according to another embodiment of the invention.

FIG. 4 is a schematic circuit block diagram illustrating the offset voltage storing and reducing circuit 122 depicted in FIG. 1 according to another embodiment of the invention. In the embodiment illustrated in FIG. 4, the offset voltage storing and reducing circuit 122 includes a sampling switch SW11, a sampling switch SW12, a resistor circuit R1, a resistor circuit R2, a sampling capacitor C5, a sampling capacitor C6 and a transconductance circuit 330. The offset voltage storing and reducing circuit 122, the sampling switch SW11, the sampling switch SW12, the sampling capacitor C5, the sampling capacitor C6 and the transconductance circuit 330 illustrated in FIG. 4 may be inferred with reference to the descriptions related to FIG. 3 and will not be repeatedly described.

In the embodiment illustrated in FIG. 4, a first terminal of the resistor circuit R1 is coupled to the second terminal of the sampling switch SW11. A second terminal of the resistor circuit R1 is coupled to the first terminal of the sampling capacitor C5. A first terminal of the resistor circuit R2 is coupled to the second terminal of the sampling switch SW12. A second terminal of the resistor circuit R2 is coupled to the first terminal of the sampling capacitor C6. The use of the additional resistor circuits R1 and R2 may improve a phase margin of an auxiliary loop. The resistor circuits R1 and R2 may be poly/diffusion resistors, transistors or any devices having limited resistance. The additional resistors R1 and R2 may create a zero point, which may compensate a $2^{nd}$ pole point to increase the phase margin, thereby loosening the compromised design between the main signal loop and the auxiliary loop.

Figure 5:
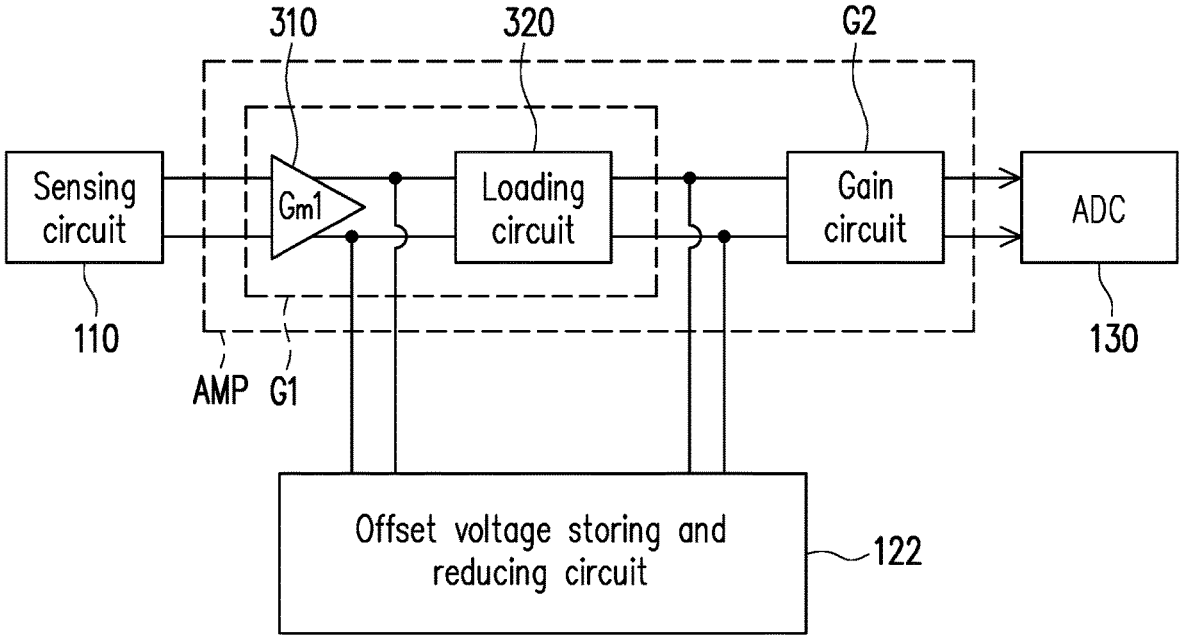
FIG. 5 is a schematic circuit block diagram illustrating the amplifier depicted in FIG. 2 according to another embodiment of the invention.

FIG. 5 is a schematic circuit block diagram illustrating the amplifier AMP depicted in FIG. 2 according to another embodiment of the invention. In the embodiment illustrated in FIG. 5, the amplifier AMP includes a gain circuit G1 and a gain circuit G2. An input terminal of the gain circuit G1 serves as the input terminal of the amplifier AMP, which is coupled to the sensing circuit 110. The output terminal of the gain circuit G1 is coupled to the input terminal of the gain circuit G2. An output terminal of the gain circuit G2 serves as the output terminal of the amplifier AMP, which is coupled to the ADC 130. The implementation manner of the gain circuits G1 and G2 is not limited in the invention. For example, based on a design requirement, the gain circuit G1 and/or G2 may be conventional gain circuits of a conventional operational amplifier, or alternatively, the gain circuit G1 and/or G2 may be other gain circuits. The amplifier AMP, the gain circuit G1, the transconductance circuit 310 and the loading circuit 320 illustrated in FIG. 5 may be inferred with reference to the descriptions illustrated in FIG. 3, and the sensing circuit 122 illustrated in FIG. 5 may refer to the descriptions related to FIG. 1, FIG. 3 and FIG. 4, which will not be repeatedly described.

In the embodiment illustrated in FIG. 5, the gain circuit G1 may serve as an input stage of the amplifier AMP, and the gain circuit G2 may serve as an output stage of the amplifier AMP. The input terminal of the offset voltage storing and reducing circuit 122 is coupled to the output terminal of the transconductance circuit 310 (i.e., the coupling terminal of the gain circuit G1). The input terminal of the offset voltage storing and reducing circuit 122 is coupled to the output terminal of the gain circuit G1. The offset voltage storing and reducing circuit 122 may store and reduce the offset voltage of the gain circuit G1.

Figure 6:
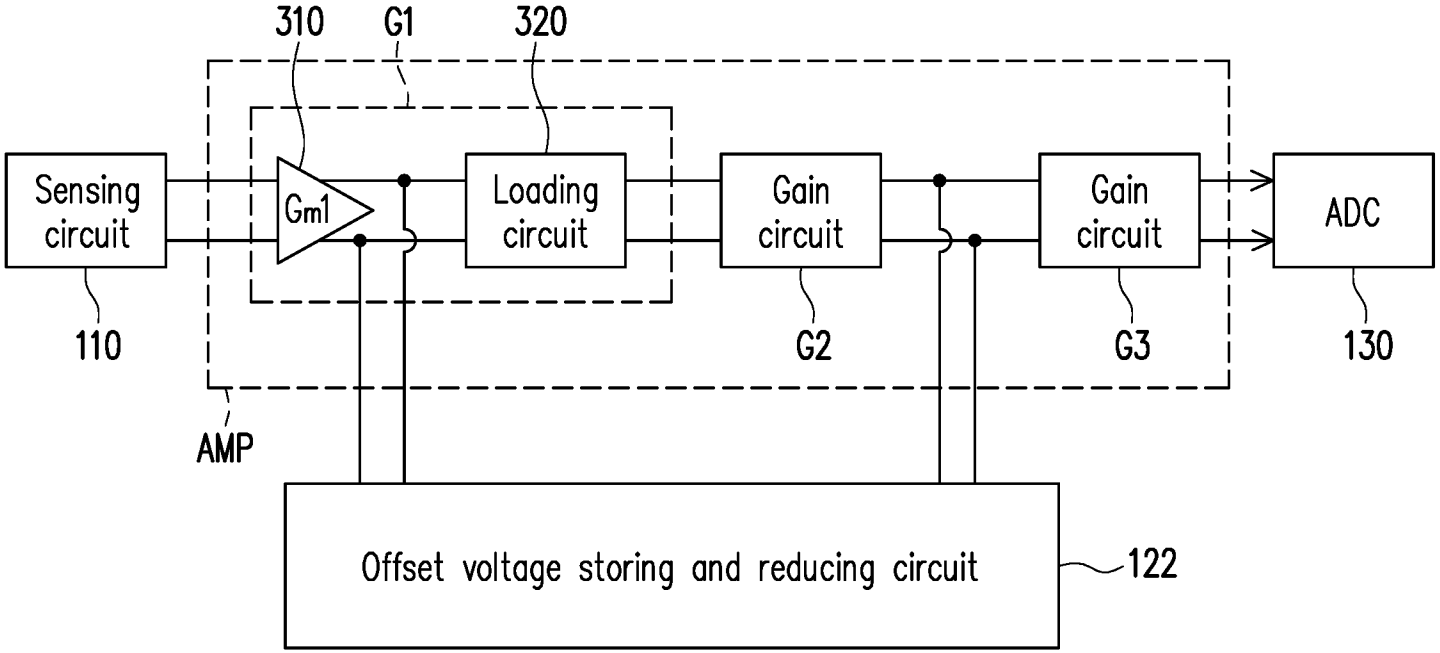
FIG. 6 is a schematic circuit block diagram illustrating the amplifier depicted in FIG. 2 according to yet another embodiment of the invention.

FIG. 6 is a schematic circuit block diagram illustrating the amplifier AMP depicted in FIG. 2 according to yet another embodiment of the invention. In the embodiment illustrated in FIG. 6, the amplifier AMP includes a gain circuit G1, a gain circuit G2 and a gain circuit G3. An input terminal of the gain circuit G1 serves as the input terminal of the amplifier AMP, which is coupled to the sensing circuit 110. An output terminal of the gain circuit G1 is coupled to the input terminal of the gain circuit G2. An output terminal of the gain circuit G1 is coupled to an input terminal of the gain circuit G3. An output terminal of the gain circuit G3 serves as the output terminal of the amplifier AMP, which is coupled to the ADC 130. The implementation manner of the gain circuits G1, G2 and G3 is not limited in the invention. For example, based on a design requirement, the gain circuits G1, G2 and/or G3 may be conventional gain circuits of a conventional operational amplifier, or alternatively, the gain circuits G1, G2 and/or G3 may be other gain circuits. The amplifier AMP, the gain circuit G1, the transconductance circuit 310 and the loading circuit 320 illustrated in FIG. 6 may be inferred with reference to the descriptions illustrated in FIG. 3, and the sensing circuit 122 illustrated in FIG. 6 may be inferred with reference to the descriptions related to FIG. 1, FIG. 3 and FIG. 4, which will not be repeatedly described.

In the embodiment illustrated in FIG. 6, the gain circuit G1 may serve as the input stage of the amplifier AMP, the gain circuit G2 may serve as a gain stage of the amplifier AMP, and the gain circuit G3 may serve as the output stage of the amplifier AMP. The input terminal of the offset voltage storing and reducing circuit 122 is coupled to the output terminal of the transconductance circuit 310 (i.e., the coupling terminal of the gain circuit G1). The input terminal of the offset voltage storing and reducing circuit 122 is coupled to the output terminal of the gain circuit G2. The offset voltage storing and reducing circuit 122 may store and reduce the offset voltage of the gain circuit G1.

It should be noted that in other embodiments, the amplifier AMP may include more than three gain circuits. For the amplifier AMP having multiple stages of gain circuits, a feedback node (i.e., a connection node of the input terminals of the of the offset voltage storing and reducing circuit 122) may be an output node of any stage (any gain circuit).

Figure 7:
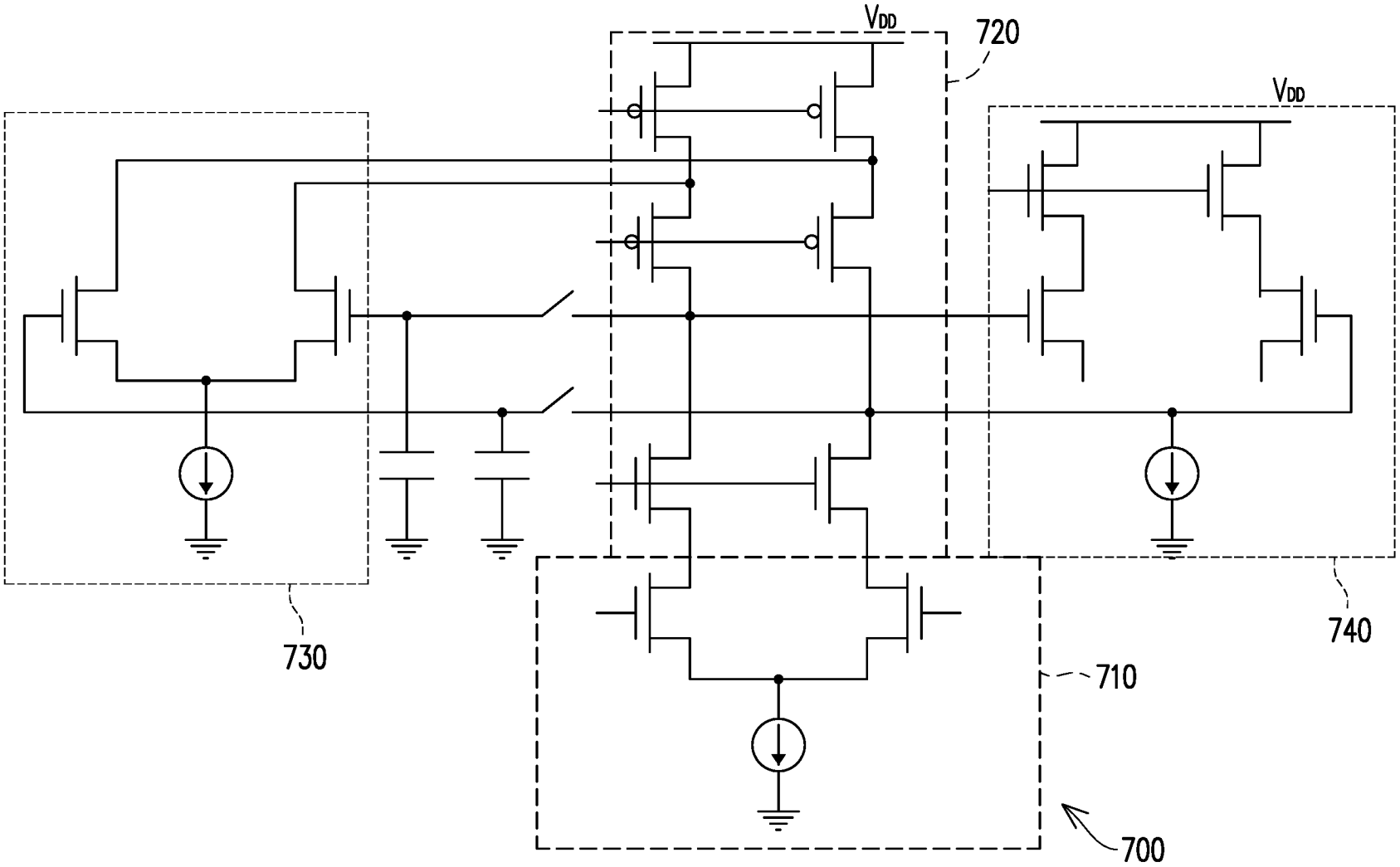
FIG. 7 is a detailed circuit diagram of an operational amplifier applicable to a source driver according to an embodiment.

FIG. 7 is a detailed circuit diagram of an operational amplifier applicable to a source driver according to an embodiment. As shown, the operational amplifier 700 can include an input pair 710 and a gain stage 720, which can be served as the transconductance circuit and a loading circuit respectively in the above embodiments such as the transconductance circuit 310 and the loading circuit 320 in FIGS. 3, 5, and 6. An auxiliary amplifier 730 can be served as a transconductance circuit of the offset voltage storing and reducing circuit in the above embodiments such as the transconductance circuit 330 of the offset voltage storing and reducing circuit 122 in FIGS. 3 and 6. Moreover, in some embodiments, an output stage 740 can be added to be served as a gain circuit such as the gain circuit G2 in FIG. 5. Other elements (such as a sensing circuit and switches, capacitors and etc.) of the offset voltage storing and reducing circuit are omitted in the diagram and details of the operation of the operational amplifier 700 can be referred to the above embodiments for brevity.

Based on the above, the operational amplifier of the source driver provided by the embodiments of the invention includes the amplifier circuit and the offset voltage storing and reducing circuit. The amplifier circuit includes the at least one gain circuit. The input terminal of the offset voltage storing and reducing circuit is coupled to the output terminal of any one of the at least one second gain circuit, so as to store the information about the offset voltage. The output terminal of the offset voltage storing and reducing circuit is coupled to the coupling terminal of the first gain circuit, so as to reduce the offset voltage of the amplifier circuit.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A source driver, configured to drive an organic light-emitting diode (OLED) display panel, comprising:

a sensing circuit, configured to sense pixel information of an OLED pixel circuit through a sensing line of the OLED display panel; and an operational amplifier, wherein the operational amplifier comprises:

an amplifier circuit, comprising a plurality of gain circuits, each of the plurality of gain circuits comprising a transconductance circuit, wherein an input terminal of the amplifier circuit is coupled to an output terminal of the sensing circuit; and an offset voltage storing and reducing circuit, wherein an output terminal of the offset voltage storing and reducing circuit is coupled to a coupling terminal of a first gain circuit among the plurality of gain circuits of the amplifier circuit, an input terminal of the offset voltage storing and reducing circuit is coupled to an output terminal of a second gain circuit among the plurality of gain circuits of the amplifier circuit, and the offset voltage storing and reducing circuit is configured to store and reduce an offset voltage of the first gain circuit of the amplifier circuit.

2. The source driver according to claim 1, wherein in a reset phase, the offset voltage storing and reducing circuit is configured to store a first voltage received from the output terminal of the second gain circuit of the amplifier circuit, wherein the first voltage carries information about an offset voltage of the first gain circuit of the amplifier circuit, and in an amplification phase, the offset voltage storing and reducing circuit is configured to output a second voltage to the coupling terminal of the first gain circuit of the amplifier circuit, wherein the second voltage carries information for reducing the offset voltage of the first gain circuit of the amplifier circuit.

3. The source driver according to claim 1, wherein the first gain circuit comprises an input stage of the amplifier circuit.

4. The source driver according to claim 3, wherein the second gain circuit comprises the input stage of the amplifier circuit.

5. The source driver according to claim 3, wherein the second gain circuit comprises one of at least one intermediate stage following the input stage of the amplifier circuit.

6. The source driver according to claim 1, wherein a first one of the plurality of gain circuits further comprises:

a loading circuit, coupled to an output terminal of the transconductance circuit of the first gain circuit among the plurality of gain circuits.

7. The source driver according to claim 6, wherein the first gain circuit comprises:

an input pair, serving as the transconductance circuit of the first gain circuit of the amplifier circuit; and a gain stage, serving as the loading circuit of the first gain circuit of the amplifier circuit.

8. The source driver according to claim 1, wherein the amplifier circuit further comprises an output stage serving as a last one of the plurality of gain circuits.

9. The source driver according to claim 1, wherein the offset voltage storing and reducing circuit comprises:

a sampling switch, having a first terminal coupled to the output terminal of the second gain circuit;

a sampling capacitor, coupled to a second terminal of the sampling switch; and a transconductance circuit, having an input terminal coupled to the second terminal of the sampling switch, wherein an output terminal of the transconductance circuit of the offset voltage storing and reducing circuit is coupled to the coupling terminal of the first gain circuit among the plurality of gain circuits.

10. The source driver according to claim 9, wherein the sampling capacitor is directly coupled to the second terminal of the sampling switch.

11. The source driver according to claim 9, wherein the offset voltage storing and reducing circuit further comprises:

a resistor circuit, having a first terminal coupled to a second terminal of the sampling switch, wherein a second terminal of the resistor circuit is coupled to the sampling capacitor.

12. The source driver according to claim 11, wherein the sampling switch is turned on in a reset phase, and the sampling switch is turned off in an amplification phase.

13. The source driver according to claim 1, further comprising:

a capacitor, having a first terminal coupled to an input terminal of the operational amplifier;

a first switch, having a first terminal coupled to a second terminal of the capacitor, wherein a second terminal of the first switch is coupled to an output terminal of the operational amplifier;

a second switch, having a first terminal coupled to the second terminal of the capacitor, wherein a second terminal of the second switch is coupled to a first reference voltage; and a third switch, having a first terminal coupled to the first terminal of the capacitor, wherein a second terminal of the third switch is coupled to a second reference voltage.

14. The source driver according to claim 13, wherein in a reset phase, the first switch is turned off, and the second switch and the third switch are turned on; and in an amplification phase, the first switch is turned on, and the second switch and the third switch are turned off.

15. The source driver according to claim 13, wherein the second reference voltage is a common mode voltage.

16. The source driver according to claim 1, wherein the sensing circuit comprises:

a switching circuit, having a first terminal coupled to the sensing line of the OLED display panel;

a sampling capacitor, coupled to a second terminal of the sampling switch; and a switch circuit, having a first terminal coupled to the sampling capacitor, wherein a second terminal of the switch circuit serves as the output terminal of the sensing circuit.

17. A source driver, configured to drive an organic light-emitting diode (OLED) display panel, comprising:

a sensing circuit, configured to sense pixel information of an OLED pixel circuit through a sensing line of the OLED display panel; and an operational amplifier, wherein the operational amplifier comprises:

an amplifier circuit, comprising a plurality of gain circuits, each of the plurality of gain circuits comprising a transconductance circuit, wherein an input terminal of the amplifier circuit is coupled to an output terminal of the sensing circuit; and an offset voltage storing and reducing circuit, wherein an output terminal of the offset voltage storing and reducing circuit is coupled to a coupling terminal of a first gain circuit among the plurality of gain circuits of the amplifier circuit, and an input terminal of the offset voltage storing and reducing circuit is coupled to an output terminal of a second gain circuit among the plurality of gain circuits of the amplifier circuit, wherein the offset voltage storing and reducing circuit comprises:

a sampling switch, having a first terminal coupled to the output terminal of the second gain circuit;

a sampling capacitor, coupled to a second terminal of the sampling switch; and a transconductance circuit, having an input terminal coupled to the second terminal of the sampling switch, wherein an output terminal of the transconductance circuit of the offset voltage storing and reducing circuit is coupled to the coupling terminal of the first gain circuit of the amplifier circuit.

18. The source driver according to claim 17, wherein the sampling capacitor is directly coupled to the second terminal of the sampling switch.

19. The source driver according to claim 17, wherein the offset voltage storing and reducing circuit further comprises:

a resistor circuit, having a first terminal coupled to a second terminal of the sampling switch, wherein a second terminal of the resistor circuit is coupled to the sampling capacitor.

20. The source driver according to claim 17, wherein in a reset phase, the offset voltage storing and reducing circuit is configured to store a first voltage received from the output terminal of the second gain circuit of the amplifier circuit, wherein the first voltage carries information about an offset voltage of the first gain circuit of the amplifier circuit, and in an amplification phase, the offset voltage storing and reducing circuit is configured to output a second voltage to the coupling terminal of the first gain circuit of the amplifier circuit, wherein the second voltage carries information for reducing the offset voltage of the first gain circuit of the amplifier circuit.

* * * * *